US007011308B2

(12) United States Patent
Race

(10) Patent No.: US 7,011,308 B2
(45) Date of Patent: Mar. 14, 2006

(54) JOYSTICK MAZE

(76) Inventor: Joseph Adrian Race, 706 Garren Creek Rd., Fairview, NC (US) 28730

( * ) Notice: Subject to any disclaimer, the term of this patent is extended or adjusted under 35 U.S.C. 154(b) by 0 days.

(21) Appl. No.: 11/042,967

(22) Filed: Jan. 24, 2005

(65) Prior Publication Data

US 2005/0167909 A1 Aug. 4, 2005

Related U.S. Application Data

(60) Provisional application No. 60/538,287, filed on Jan. 23, 2004.

(51) Int. Cl.
*A63B 67/14* (2006.01)
*A63F 7/07* (2006.01)

(52) U.S. Cl. ..... 273/110

(58) Field of Classification Search ..... 273/109, 273/10, 113, 115, 116
See application file for complete search history.

(56) References Cited

U.S. PATENT DOCUMENTS

| | | | | |
|---|---|---|---|---|
| 2,563,334 A | * | 8/1951 | Hotte | 273/110 |
| 3,384,374 A | * | 5/1968 | Boothe | 273/110 |
| 3,636,650 A | * | 1/1972 | Honig | 446/487 |
| 3,698,713 A | * | 10/1972 | Jimerson | 463/65 |
| 4,089,526 A | * | 5/1978 | Olving | 273/110 |
| 4,166,327 A | * | 9/1979 | Wressell | 434/71 |
| 4,216,963 A | * | 8/1980 | Boucher | 273/110 |
| 4,248,427 A | * | 2/1981 | Vierimaa | 273/110 |
| 4,257,600 A | * | 3/1981 | Goldfarb | 273/110 |
| 4,258,918 A | * | 3/1981 | Nishimiya | 273/110 |
| 4,325,551 A | * | 4/1982 | Kulesza et al. | 273/110 |
| 4,448,416 A | * | 5/1984 | Belter | 273/110 |
| 5,042,808 A | * | 8/1991 | Shoptaugh | 273/110 |
| 5,901,612 A | * | 5/1999 | Letovsky | 74/471 XY |
| 6,742,780 B1 | * | 6/2004 | Rudski | 273/109 |
| 2005/0167909 A1 | * | 8/2005 | Race | 273/110 |

* cited by examiner

*Primary Examiner*—Raleigh W. Chiu

(57) ABSTRACT

Joystick Maze is an educational labyrinth game with the objective of demonstrating mechanical linkage while moving a steel ball across a game board from point A to point B. The game board consists of two parallel connected surfaces with the upper surface incorporating a series of holes and rails, while the lower surface acts as a retrieval platform should the ball fall through any of the holes. The steel ball is moved by gravity resulting from the tilting of the game board. A remote control device (Joystick) effectuates the tilting through rigid linkage. The linkage is connected to rotator bearings, directly attached to the under surface of both the game board and joystick, which are seated in a ringed housing. The construction provides for precise coordinated movement between the control device and the board simultaneously eliminating the necessity of a housing thereby allowing observation of the mechanical linkage.

3 Claims, 3 Drawing Sheets

JOYSTICK MAZE

This application claims priority of the provisional application Appl. No. 60/538,287 filed on Jan. 23, 2004.

BACKGROUND OF THE INVENTION

Single control device labyrinth games incorporate mechanical linkage between a game board and control device. The use of rigid mechanical linkage, rather than wire, pulleys or springs, provides for greater sensitivity.

In U.S. Pat. No. 3,384,374 by Boothe, the tilting of the board is achieved by use of multiple pivotal points across both the x axis and y axis. The ball retrieval system incorporates a slanted surface at the base of the game housing. The retrieval system as well as the multiple pivotal system necessitates the use of a enclosed housing or cabinet.

U.S. Pat. No. 3,554,553 issued to Hayashi, discloses a labyrinth type game which does not incorporated the use of holes in the game board or retrieval devices. The game is however constructed with a connecting lever member attached to the center of the game board. The lever member is in turn connected to a pivotal point fastened to and located within an enclosed housing. The housing restricts the tilting of the board as it comes into contact with the housing surface. The housing also precludes observation of the linkage thus varies from my invention which educates the player about mechanical linkage.

In U.S. Pat. No. 5,213,325 by Malavazos, a single control device labyrinth type game is presented. It differs from the proposed objectives of my invention in many respects. Some of the most notable are: the complexity of the design requires a cabinet to secure the various component; the yoke is incorporated into the connecting rod rather than the attached to the rotator bearing: the connecting rod's flat surface are housed in the yoke in such a manner as to create friction: the multiple bias springs are of a compression type and positioned in several locations.

BRIEF SUMMARY OF THE INVENTION

Joystick Maze is a recreational/educational device having a game board capable of being tilted by a remote control device in any direction up to 30 degrees from its horizontal plane. The tilting of the board creates a gravitational force causing a steel ball to move about the board. The objective of the game is to navigate the steel ball from point A to Point B around holes and rails, constructed on the upper surface of the game board. The upper surface can be removed and replaced with other configured game boards. The game board has a connected and enclosed parallel lower surface which acts as a retrieval platform should the ball fall through a hole.

Incorporating the retrieval platform into the game board eliminates the necessity to utilize a slanted surface on the base of the game and further eliminates the enclosed housing. The absence of the enclosed housing or cabinet allows one to observe and learn about the working of mechanical linkage.

Rotator bearings are attached directly to the under surface of the board and control device. The rotator bearings are seated in ringed housings. Each ringed housing is supported by two metal support rods fasten to opposite sides of the housing. These rods are fixed to the housing at a 35 degree angle. The resulting configuration eliminates the obstruction of the enclosed housing, creating the ability to tilt the board at an angle of 30 degrees. The increase angle of tilt causes the ball to roll faster, which an experienced player may use to jump a hole.

The control device and game board are joined by a connecting rod. In the middle of the connecting rod is a spring, which in turn is fastened to the game base. The single spring creates a horizontal bias on the board.

The threaded connecting rod is inserted into a hole drill through the pin. The connecting rod is held in place by two nuts screwed onto the rod and tightened firmly against either side of the pin. This arrangement creates several advantage; tightly fastening the control rod to the yoke pin reduces internal component play which increase sensitivity between the control device and board movement; with the connecting rod centered on the yoke pin, contact between the sides of the yoke and connecting rod is eliminated, thereby reducing unwanted friction; the small diameter of the connecting rod in conjunction with other design consideration, lower the height profile of the device making it suitable for desk top play; the connecting rod attachment is consistent with other elements of the invention which in totality allows an enthusiastic player to easily disassemble and reassemble the mechanical linkage, thereby enhancing the educational aspect of the device.

BRIEF DISCRIPTION OF THE DRAWINGS

DETAILED DISCRIPTION OF THE INVENTION

Figure 1:
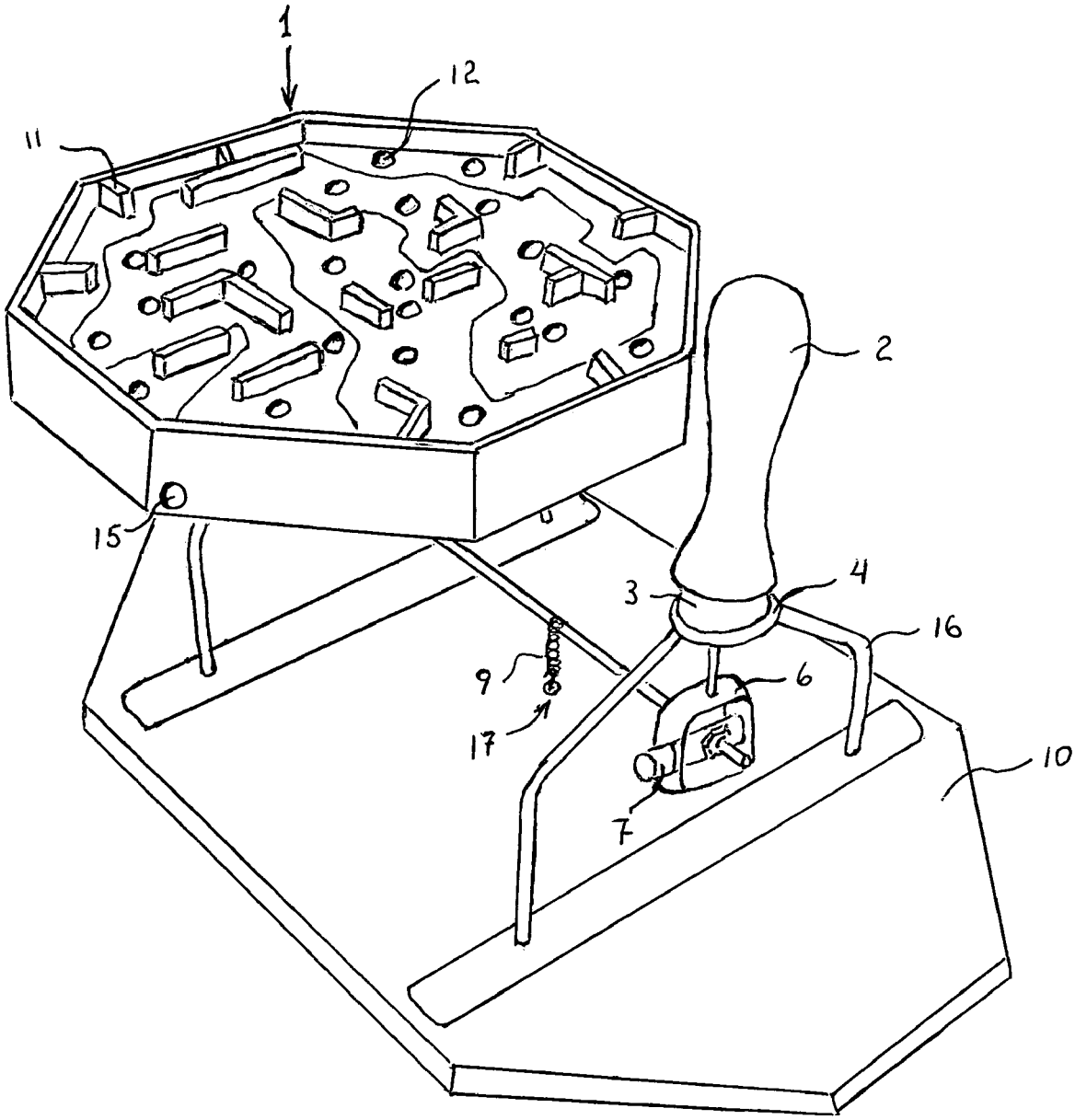
FIG. 1 is a perspective view of a device constructed and assembled in accordance with the intent of this invention.

Referring to FIG. 1 Joystick Maze is an educational amusement game with the objective of moving a steel ball from Point A to Point B. The game board 1 consists of a series of holes 12 through which the ball can fall, and rails 11 against which the ball can bounce or upon which the ball can rest. The movement of the ball is dictated by gravity. The gravitational forces are a direct result of the tilting of the board. The game board can be tilted in any direction on the horizontal plane up to 30 degrees vertically. The tilting of the board is accomplished through a single remote control device 2 fastened through linkage to the center of the game board. Again referring to FIG. 1 the game board and control device are fixed to the game base 10 in such a manner as to allow the player to observe and learn about basic mechanical linkage.

Figure 2:
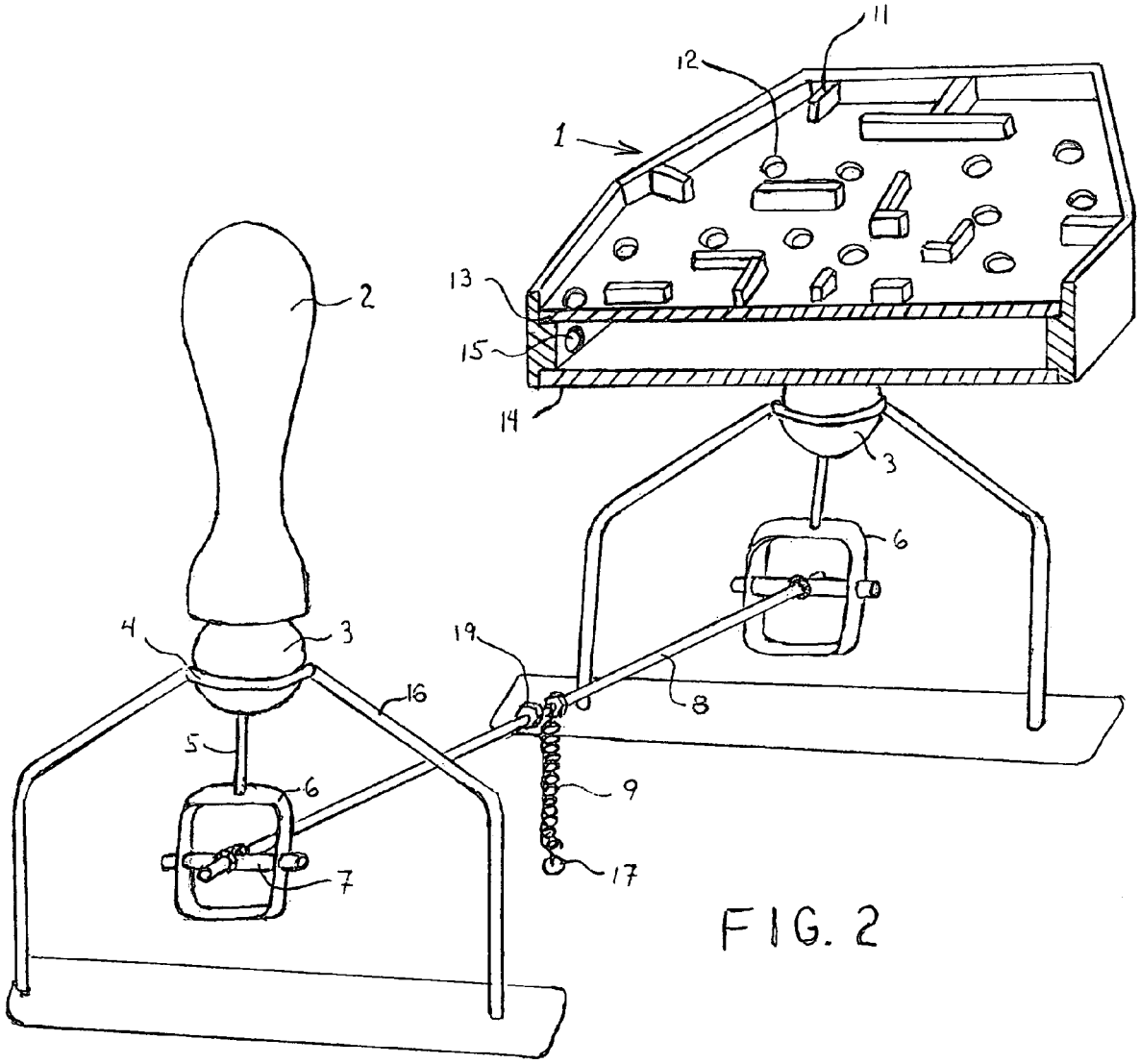
FIG. 2 is an elevated section view of the game board showing the upper and lower surfaces, it also shows the mechanical linkage between the game board and the control device.

Referring to FIG. 2, fixed to the under surface of the game board and control device are rotator bearings 3. In the case of Joystick Maze, the bearings are constructed of oak with a polished surface. The rotator bearings are seated in polished steel ringed housing 4. Given that the contact surface between the housings and bearings is minimal, and the surfaces are both hard and polished, friction has been significantly reduced. As a result the control devise moves effortlessly and the game board responds precisely.

Figure 3:
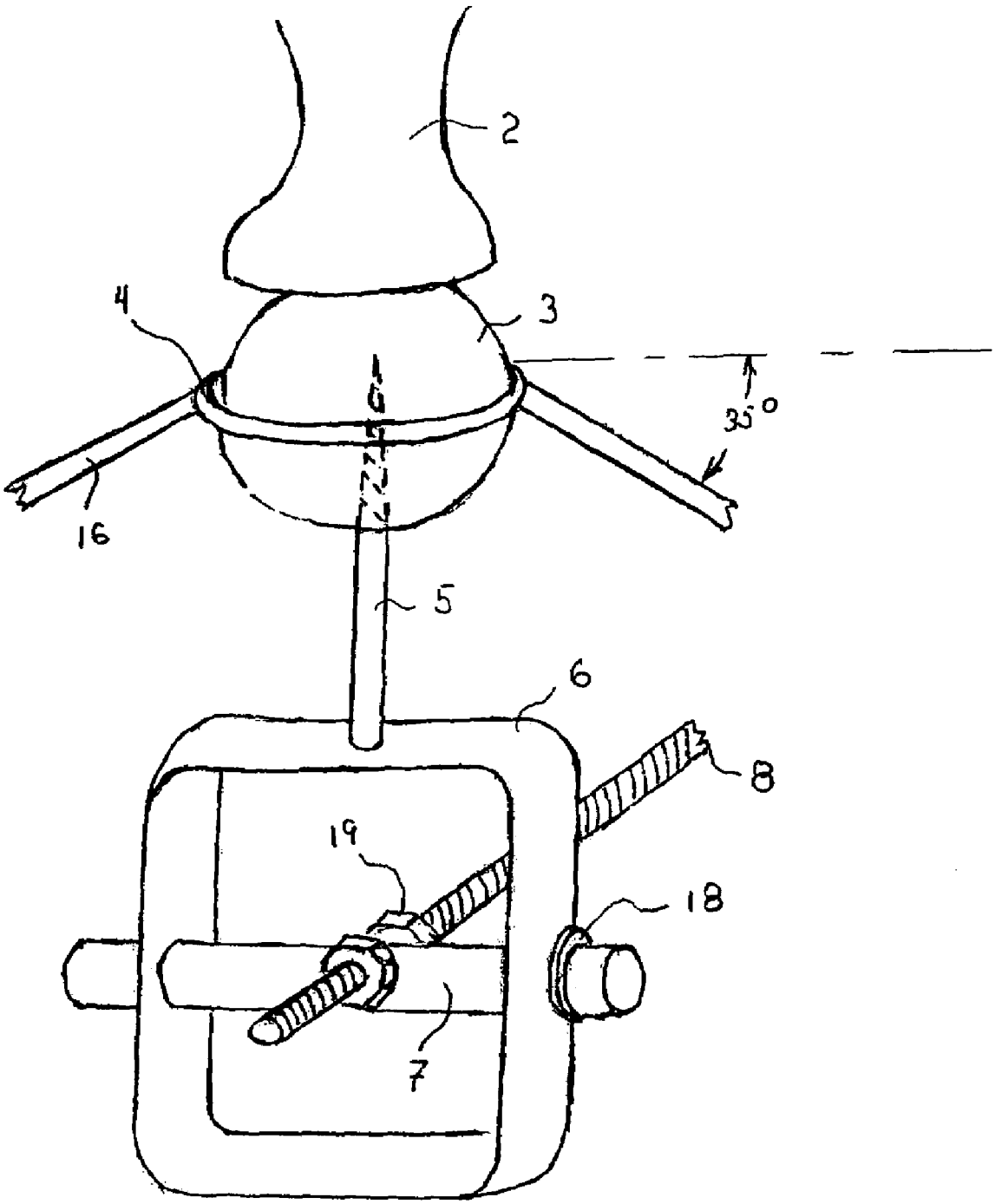
FIG. 3 is an exploded view of the mechanical linkage specifically depicting a rotator bearing, ringed housing, lever, yoke, pin and connecting rod end.

The rotator bearings are in turn connected to yokes 6 through levers 5. FIG. 3 The levers are metal rods with wooden screw threads at their upper ends. The levers, which are spot welded to the yokes, are simply screwed into holes drilled into the bottom of the rotator bearings.

In the center of the each yoke a yoke pin 7, consisting of ½" steel rod, is vertically inserted. ½" diameter holes are drilled in the sides of the yoke but reamed an additional 0.005 inch. The yoke and pin are constructed with hard materials and to high tolerances. As a result there is minimal friction loss when the pin rotates with the forward and aft movement of the control device. It is also worthy of note that the connecting rod 8 does not come into contact with the side of the yoke, thereby reducing frictional losses. Moreover the yoke pin acts as a torque bar when the control lever is move side to side, thereby enhancing responsive board movement. FIG. 3 Groves are cut in the far side of each yoke pin to accommodate retaining pins 18 which prevent the yoke pins from moving laterally.

FIG. 3 shows that the connecting rod 8 is inserted through a hole in the center of the yoke pin. Nuts 19, threaded onto the connecting rod, are securely fastened to both sides of the yoke pin. The resulting rigidity further reduces any unwanted play as the control device is moved forward and aft.

A bias spring is attached between the center of the connecting rod and a hook 17, which is screw into the game base. The spring causes the game board to maintain a bias on the horizontal plane.

Referring to FIG. 2, the cross section reveals that the game board has an upper surface 13 and a lower surface 14. When the ball drop through a hole on the upper surface it is captured on the lower surface and can be retrieved through the retrieval hole 15. This can be accomplished by simply rotating the game board to the left.

Referring to FIG. 3 and FIG. 2, support rods 16, which are nothing more than steel rod, are notched and spot welded to the ringed housing. They are fastened at a 35 degree angle. This allows for optimum tilt of the game board, while retaining the shown yoke configuration and maintaining a minimal height profile. 35 degrees clearance between the game board and support rods produces the greatest angle of tilt before either the lower surface of the board or the yoke strikes a support member. The steeper tilting produces a faster moving ball enabling an experienced player to cause the ball to jump a hole. This also allows the game board to be exchanged with other game board which may require a steeper angle of attack.

As to the educational aspects of this amusement device, as previously stated the invention clearly eliminates the necessity of an enclosed housing or cabinet. This arrangement allows the player to observe and learn about basic mechanical linkage. The construction is intentionally simple. This allows an enthusiastic and perhaps youthful operator not only to observe the linkage but also disassemble and reassemble the entire mechanical linkage with a couple of basic tools.

I claim:

1. An educational amusement device with a rolling ball on a game board capable of tilting with a remote control device with mechanical linkage connecting the game board and control device wherein said mechanical linkage is both viewable and readily accessible comprised of a. a pair of main rotator bearings centered and directly attached to the game board and control device wherein the rotator bearings are seated in ringed bearing housings, each of which is supported by two metal rods, fastened to opposite sides of the housing and fixed at a 35 degree downward angle, and fastened to the game base:

b. a yoke attached to each bearing by means of a bearing lever with a pin running through each yoke, secured by clips, and capable of rotating within the yoke, having a hole drilled through each pin:

c. a threaded connecting rod inserted into the pins through the predrilled holes and secured by means of nuts, tightened against opposite sides of each pin.

2. The device of claim 1 with a spring attached to the center of the connecting rod and the game base, providing for horizontal bias of the game board.

3. The device of claim 1 with a game board comprising of two parallel connected surfaces whereby the upper surface contains holes and rails with the designated path of the rolling ball and the lower parallel surface providing a retrieval platform should the ball fall through a upper surface hole.

* * * * *